US008366068B2

(12) United States Patent
Schmied

(10) Patent No.: US 8,366,068 B2
(45) Date of Patent: Feb. 5, 2013

(54) BRACING STRUCTURE, FASTENER AND METHOD FOR BRACING A SUPPORT STRUCTURE HAVING PROPS FOR CEILING FORMWORKS

(75) Inventor: Anton Schmied, Boheimkirchen (AT)

(73) Assignee: Doka Industrie GmbH (AT)

( * ) Notice: Subject to any disclaimer, the term of this patent is extended or adjusted under 35 U.S.C. 154(b) by 1261 days.

(21) Appl. No.: 11/767,282

(22) Filed: Jun. 22, 2007

(65) Prior Publication Data

US 2008/0001049 A1 Jan. 3, 2008

Related U.S. Application Data

(60) Provisional application No. 60/816,230, filed on Jun. 23, 2006.

(30) Foreign Application Priority Data

Jun. 23, 2006 (DE) ..... 20 2006 009 860 U

(51) Int. Cl.
*A47F 5/00* (2006.01)

(52) U.S. Cl. ..... 248/351; 248/229.12; 52/127.2

(58) Field of Classification Search ..... 248/65, 248/67.5, 67.7, 68.1, 73, 74.1, 74.2, 74.4, 248/74.5, 228.1, 228.2, 228.3, 228.6, 229.2, 248/229.21, 229.11, 231.21, 231.71, 231.31, 248/230.3, 343, 222.13, 223.41, 224.51, 248/245, 411, 412, 551, 552, 553, 686, 688, 248/229.12; 182/186.7, 178.1, 179.1; 292/342; 269/234; 52/127.2; 211/192; 249/192, 47, 249/219.1, 342

See application file for complete search history.

(56) References Cited

U.S. PATENT DOCUMENTS

| | | | | |
|---|---|---|---|---|
| 378,256 | A * | 2/1888 | Lee | 99/339 |
| 1,593,610 | A * | 7/1926 | White | 249/48 |
| 2,381,584 | A * | 8/1945 | Fulleton | 269/43 |
| 3,955,644 | A * | 5/1976 | Steele | 182/82 |
| 4,188,017 | A * | 2/1980 | Dingler | 249/219.1 |
| 4,529,163 | A * | 7/1985 | Dingler | 249/192 |

(Continued)

FOREIGN PATENT DOCUMENTS

| | | |
|---|---|---|
| DE | 27 07 547 A1 | 1/1979 |
| DE | 36 41 349 A1 | 6/1988 |

(Continued)

OTHER PUBLICATIONS

European Search Report for European Patent Application No. 07 012 054.8, issued on Mar. 22, 2012, 3 pages.

*Primary Examiner* — Terrell McKinnon
*Assistant Examiner* — Eret McNichols
(74) *Attorney, Agent, or Firm* — Fitch Even Tabin & Flannery, LLP

(57) ABSTRACT

In one form, a bracing structure for bracing a support structure having props for ceiling formworks is provided and includes: two vertical sections joined to one another by at least one horizontal section, at least one seating element on each vertical section each having at least one seating recess for placement of a prop, whereby the opening direction of the seating recesses on the respective vertical sections point away from each other and the opening directions lie parallel to the plane defined by the vertical sections, wherein each vertical section has at least one fastener for attaching the bracing structure to the prop with at least one of the fasteners comprising at least one of the seating elements. In other forms, a fastener for attachment of a supporting structure to a prop is provided, and a method for bracing a support structure having props for ceiling formworks is provided.

10 Claims, 2 Drawing Sheets

U.S. PATENT DOCUMENTS

| | | | | | |
|---|---|---|---|---|---|
| 4,881,716 | A | * | 11/1989 | Dingler | 249/192 |
| 5,024,037 | A | * | 6/1991 | Ono | 52/646 |
| 5,546,724 | A | * | 8/1996 | Reinklou | 52/698 |
| 5,685,112 | A | * | 11/1997 | Fara | 52/202 |
| 6,079,173 | A | * | 6/2000 | Waalkes et al. | 52/239 |
| 7,648,306 | B2 | * | 1/2010 | Schworer | 403/373 |
| 7,665,252 | B2 | * | 2/2010 | Lang | 52/127.2 |
| 8,109,363 | B2 | * | 2/2012 | Dubbert et al. | 182/82 |
| 2004/0211147 | A1 | * | 10/2004 | Vanagan | 52/720.1 |
| 2008/0017783 | A1 | * | 1/2008 | Vanagan | 249/192 |

FOREIGN PATENT DOCUMENTS

| | | | |
|---|---|---|---|
| EP | 0 252 748 | A2 | 1/1988 |
| FR | 2 693 498 | A1 | 1/1994 |

* cited by examiner

BRACING STRUCTURE, FASTENER AND METHOD FOR BRACING A SUPPORT STRUCTURE HAVING PROPS FOR CEILING FORMWORKS

FIELD OF THE INVENTION

The present invention relates to a bracing structure which is used in particular in support structures having props for ceiling formworks, especially in the construction industry. The invention further relates to a fastener for attaching such a bracing structure to props as well as a method for bracing a support structure having props for ceiling frameworks.

BACKGROUND OF THE INVENTION

In formwork construction and especially when forming ceilings it is necessary for ceiling formworks to be supported in relation to the levels underneath them, such as the ground, the floor slab or the floor disposed underneath them. An established procedure for this is the arrangement of props between the level and the ceiling formworks supported directly or indirectly (for example by means of intermediate beams) on the props. These props together form the support structure supporting the ceiling formworks.

Various devices are known in order to prevent these props, which support the ceiling formworks directly or indirectly during assembly, use and stripping, from collapsing, tilting or even buckling.

Supporting legs, for example, which are usually folding tripods, are used as erection aids for the props and serve to prevent the props and/or the entire formworks from collapsing when stripping the ceiling.

In some countries, especially the USA, it is also stipulated that the horizontal forces arising due to the erection and stripping of a ceiling formworks must be dissipated by the support structure supporting said ceiling formworks.

A conventional possibility of bracing the support structure made up of props is the introduction of cross braces between the individual props in order to creating a bracing structure. In this case, two adjacent props are each joined together by way of cross braces and are secured against moving or collapsing by the resulting bracing structures. The erection of such a support structure is labor-intensive as a large number of cross braces have to be fitted in.

A further possibility for bracing support structures created from props is the use of bracing frames which are used in each case to connect two adjacent props. WO 2005/090710 A1 discloses such a bracing frame.

The construction of prop rows with supporting frames, which are linked together by way of cross braces, is known from FR 2693498 A1.

DE 36 41 349 C5 pertains to a construction prop which can be joined with frame-shaped supplementary braces. The supplementary braces can have two vertical rails, to which props abut. The attachment can be carried out by clamp screws.

A support structure with cross beams is known from EP 0 252 748 A2, which can be attached to a prop by screws extending perpendicular hereto and by a divided fastener having projections. The prop comprises undercuts for this.

In the known bracing frames the props are accommodated in clamps (scaffold couplers) or other seating elements which are open towards the side.

The known bracing frames, therefore, have the disadvantage that either they can only accommodate one single type of prop or, on accommodating props of different origin and varying diameters, the relative positions of the individual bracing frames disposed parallel to each other, and thus also the gaps to be bridged via the cross braces, vary. Furthermore, it is necessary to align the props very precisely and simultaneously so that the bracing frames can be brought into position without difficulty. This leads to a relatively time-consuming erection of the support structure for the ceiling formworks structure.

SUMMARY OF THE INVENTION

Accordingly, the object of the present invention is to provide a bracing structure which enables a high level of flexibility in application and which simplifies the handling and erection time. A further object of the present invention is to specify a fastener for such a bracing structure.

This object is achieved by a bracing structure as described hereinafter. Advantageous developments of the bracing structure are set forth herein.

Accordingly, the bracing structure for bracing a support structure having props for ceiling formworks comprises two vertical sections located at a distance from one another which are joined to one another by at least one horizontal section. Furthermore, on each vertical section is provided at least one seating element, which in each case has at least one seating recess for placement of a prop, whereby the opening direction of the seating recesses on the one vertical section and the opening direction of the seating recesses on the other vertical section point substantially away from each other and the opening directions lie substantially parallel to the plane defined by the vertical sections.

This bracing structure as described above has the advantage that the seating recesses pointing in opposite directions, which at the same time open in a direction parallel to the plane defined by the vertical sections, enable the bracing structure to be attached simply and efficiently to a prop. Due to this special arrangement of the seating recesses, it is possible to connect props of different origin and of different diameters to the supporting structure without the distance of the supporting structure in one row of props altering from that of the supporting structure in an adjacent row of props. The introduction of a cross brace perpendicular to the plane defined by the vertical sections is thus independent of the props used and in principle it is possible to use cross braces of the same dimension (length) in the entire support structure whereby their length is determined by the distance between the rows of props. The distance between the rows of props correlates for its part with the formwork grid. The seating elements are distinct elements provided, for example, in a projecting manner on the vertical section. By this, a statically defined seating of a prop can be achieved, for example, by two seating elements. It must be mentioned that the prop can have, for example, a cross-section that is substantially round.

The bracing structure is easy to assemble as it only has to be attached to one front prop parallel to the row of props in the direction of said row of props and a rear prop can be attached to the bracing structure so that the props take up the correct position. This is regardless of the origin and diameter of the props, making it possible to achieve a flexible construction. In particular, due to supporting structure, it is easy to compensate changes in the diameter or the structure of the props as a change in the diameter of the relevant props merely causes a displacement of the bracing structure in the direction of the plane defined by the vertical sections. A displacement of the bracing structure perpendicular to the row direction or perpendicular to the plane which is defined by the frame does not occur with the bracing structure described above.

Accordingly, it is possible to maintain a distance between two adjacent rows of props of different diameters such that it is still possible to apply bracing stays between the two rows or between the bracing structures without difficulty regardless of the diameter of the relevant props.

By using seating elements with the appropriately orientated seating recesses, the only change, which occurs where there is a variation in the diameters of the relevant props, is the axial distance between the props in the plane of the bracing structure but not the distance to the adjacent prop at a right angle thereto. This distance is always kept the same by the cross brace and correlates with the ceiling formworks grid.

In a preferred embodiment, at least one fastener is provided on each vertical section for attaching the bracing structure to the prop. The fastener improves the supporting effect as said effect then also extends in the direction pointing away from the seating recess. Furthermore, assembly of the supporting structure is simplified as the supporting structure is attached to a first prop by means of the fastener and can be fixed before the second prop is abutted to the supporting structure. Corresponding to the seating elements provided at discrete points, at least one fastener is provided at one point where a seating element is provided. By this, a defined seating and fastening can be achieved.

Preferably, at least one of the fasteners comprises at least one of the seating elements referred to above. This makes it possible to prevent bending moments from being applied to the prop, as the plane in which a support butts against the bracing structure is clearly prescribed by the seating elements or their seating recesses and these are a defined distance apart.

For reliable attachment of the bracing structure's fastener, said fastener preferably has a clamping element, which cooperates with the seating element for clamping a prop, whereby the clamping element is displaceably disposed in opposition to the opening direction of the relevant seating recess. At the same time, the clamping element may be guided so as to be linearly displaceable on a section of the seating element or also by other means. Furthermore, it may be possible to bring the clamping element into its clamping position by means of a locking element, whereby the locking element may be formed as a locking key. In this way it is possible to achieve reliable clamping of a prop in the fastener. A linear displaceability of the clamping element relative to the seating recess or the seating element ensures that at least in the plane defined by the vertical sections there is no change to the bracing structure's geometry in the installed condition regardless of the diameter, the profile or the origin of the props to which the bracing structure is fastened.

In an advantageous development, the clamping element has at least two different seating positions for clamping of props with different dimensions or different diameter, whereby the different seating positions may act on the spine of a locking key.

The embodiments of the fastener referred to above specify reliable, flexible and easy to handle means.

In order to facilitate easy bracing of the props in a prop row without the fasteners of two bracing structures interfering with each other, the fastener of one supporting structure is disposed in a different position along the vertical section on the one vertical section than is the fastener on the other vertical section. In this way it is possible to ensure that bracing structures can be used in the correct orientation in a prop row without them interfering with each other. In particular, it is also possible in this way to attach two bracing structures to a single prop on opposing sides. To do this, for example, one of the fasteners may be above and the other below a central axis lying in the plane defined by the vertical sections.

In a preferred embodiment, the opening directions of all seating recesses of the seating elements disposed on one vertical section point in the same direction in each case. As a result it is easy to attach the supporting structure to the relevant prop and at the same time to achieve an attachment to the prop which is as sturdy as possible.

Preferably, the relevant seating recesses lie in a common attachment plane in each case with the result that a prop can be brought evenly into contact in all seating recesses of the seating elements. As a result of this it is also especially possible to prevent undesirable bending stresses from being applied to the props accommodated in the seating recesses.

Preferably, at least one of the seating recesses is formed in a V shape. The V-shaped design ensures that props of different diameters, different (symmetrical) profiles and different origin can easily be accommodated in the recesses since the V-shaped recess adapts to the different diameters virtually automatically. Furthermore, the V shape ensures that the position perpendicular to the plane of the bracing structure is maintained even with dissimilar diameters. In other words, the bracing structure always centers itself in its central plane regardless of the diameter, the material or the profile of the props used.

In an advantageous embodiment, the seating recess is designed such that no more than 50% of a prop can be accommodated in the respective seating recess. This has the advantage that the seating elements of two bracing structures attached to the same prop do not interfere with each other. This is especially advantageous if the seating elements of a first bracing structure are disposed at exactly the same height on the prop as the seating elements of a second bracing structure. It is possible to ensure by means of this design that the relevant prop is in full contact in the seating recess.

In a preferred example, at least one cross brace fastener is provided for fastening a cross brace disposed perpendicular to the plane of the frame. Preferably, this cross brace fastener is a locking pawl bolt for fixing a cross brace stay.

The object referred to above is further achieved by a fastener for fixing a supporting structure. Advantageous developments are described hereinafter.

Accordingly, the fastener comprises a seating element with a seating recess for seating of a prop to be attached and a clamping element which is linearly displaceable in opposition to the opening direction of the seating recess such that a prop can be clamped in the fastener.

BRIEF DESCRIPTION OF THE DRAWINGS

The invention is described in greater detail in the following on the basis of an exemplary, non-limiting embodiment with reference to the drawings wherein.

DETAILED DESCRIPTION OF THE PREFERRED EMBODIMENTS

Figure 1:
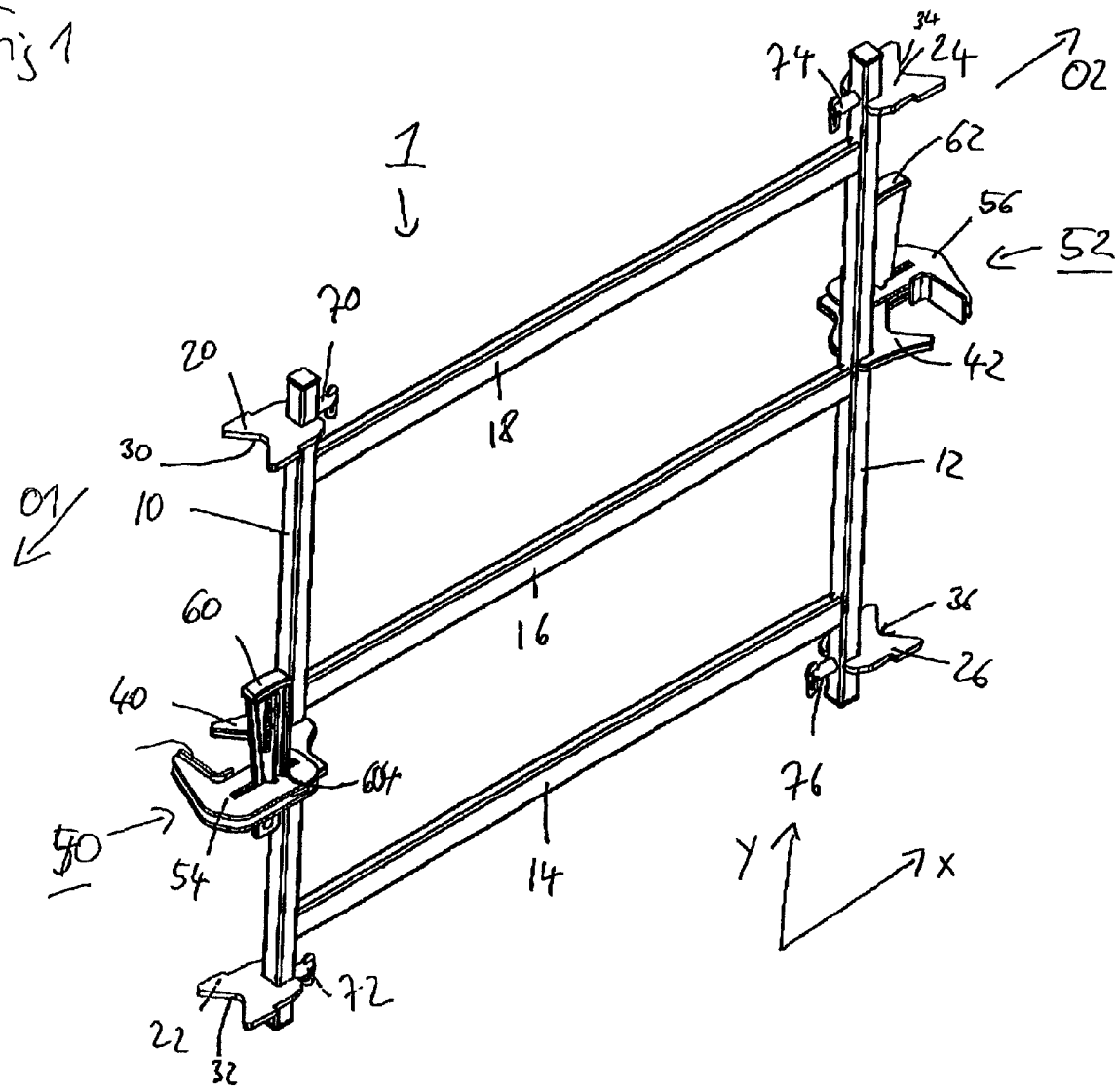
FIG. 1 shows a bracing structure according to an embodiment.

FIG. 1 shows a bracing structure 1 which has two vertical sections 10, 12 and horizontal sections 14, 16, 18 situated there between. Vertical sections 10, 12 and horizontal sections 14, 16 18 together form a frame which constitutes the actual supporting frame. This supporting frame also farther defines a plane XY, which is spanned substantially by two vertical sections 10, 12. More accurately, plane XY is spanned in the vertical direction (Y-direction) by vertical sections 10, 12 and in the horizontal direction (X-direction) by the spacing of vertical sections 10, 12 applied by horizontal sections 14, 16, 18.

Even if, in the following, the respective frame elements are termed as vertical or horizontal elements, these terms only refer, however, to a single possible orientation of bracing structure 1. It is clear that bracing structure 1 can also be disposed in completely different arrangements in which vertical sections 10, 12 are then no longer disposed in the vertical direction but in some other spatial orientation. The terms "horizontal" and "vertical" are only used in the present disclosure to keep the description as comprehensible as possible with reference to FIGS. 1 and 2.

On vertical section 10 are provided seating elements 20, 22 which have seating recesses 30, 32. In the embodiment illustrated, seating recesses 30, 32 have a substantially V shape whereby the point of the V points in the direction of other vertical section 12.

Seating elements 20, 22 are formed as plate elements perpendicular to plane XY, which is defined by vertical sections 10, 12, said plate elements being attached to vertical sections 10, 12 and having seating recesses 30, 32 introduced in them.

A mirror image of this arrangement is also present for seating elements 24, 26 on vertical section 12, where seating recesses 34, 36 likewise have a V shape whereby the point of this V then points in the direction of opposing vertical section 10.

In other words, seating recesses 30, 32, 34, 36 are formed such that in each case they have an opening direction O1, O2 which lies parallel to plane XY defined by vertical sections 10, 12, whereby opening direction O1 of seating recesses 30, 32 on first vertical section 10 points away from opening direction O2 of seating recesses 34, 36 of second vertical section 12.

The concept of opening directions O1, O2 of seating recesses 30, 32, 34, 36 respectively is understood here to mean the directions in which a perpendicular, standing on a virtual connecting line between the two outermost points of the respective recess, points and points out of the seating recess. In the present embodiment, this direction is, therefore, also identical to the opposite direction in which the point of the V indicates.

In addition to seating elements 20, 22, 24, 26, fasteners 50, 52 are provided on the bracing structure with which bracing structure 1 can be attached to props not shown here. Fasteners 50, 52 each comprise a further seating element 40, 42 which, in its basic structure and especially in its shape and alignment of the respective seating recess, is identical to other seating elements 20, 22, 24, 26. Seating element 40, 42 is counted among further seating elements 20, 22, 24, 26.

In the case of fasteners 50, 52, in addition to seating elements 40, 42 are provided clamping elements 54, 56 respectively which are moveable towards the seating recess of respective seating element 40, 42. In particular, clamping elements 54, 56 can be moved towards the seating recesses of seating elements 40, 42 such that a prop located in the seating recess, but not shown here, is pressed into the seating recess and thus the bracing structure is clamped on the relevant prop. The movement of clamping elements 54, 56 for clamping of a prop is a linear movement which runs parallel to plane XY defined by vertical sections 10, 12.

Seating elements 20, 22, 24, 26, 40, 42 are permanently fixed to respective vertical stays 10, 12, in particular by soldering, welding, bonding or another appropriate type of attachment which permits durable and rugged fixing.

The force for clamping of the relevant clamping element is applied in the embodiment illustrated by keys 60, 62. Taking fastener 50 as an example, key 60 acts with its front side 606 on a front contact surface 406 of seating element 40, and a seating position 550 on clamping element 54 interacts with a rear side 604 of key 60. Correspondingly, clamping element 54 is displaced in relation to seating element 40 and may be displaced linearly by key 60 by the application of a key force in the direction of the seating recess of seating element 40.

The fastener will be described again in greater detail in the following with reference to FIG. 2. In particular, seating element 40 which is disposed on vertical section 10 and which is permanently attached to vertical section 10, is illustrated.

Furthermore, clamping element 54, which may be displaced linearly in one direction in relation to seating element 40, is shown; said direction being parallel to plane XY defined by vertical sections 10, 12.

Clamping element 54 has a bottom key plate 540 and a top key plate 542 which are joined to each other by a guide element 544 as well as by a clamping plate 548. Bottom key plate 540 and top key plate 542 are in contact with the bottom side and the top side respectively of seating element 40 and are linearly guided on seating element 40 by guide element 544 plus a section of clamping plate 548.

Figure 2:
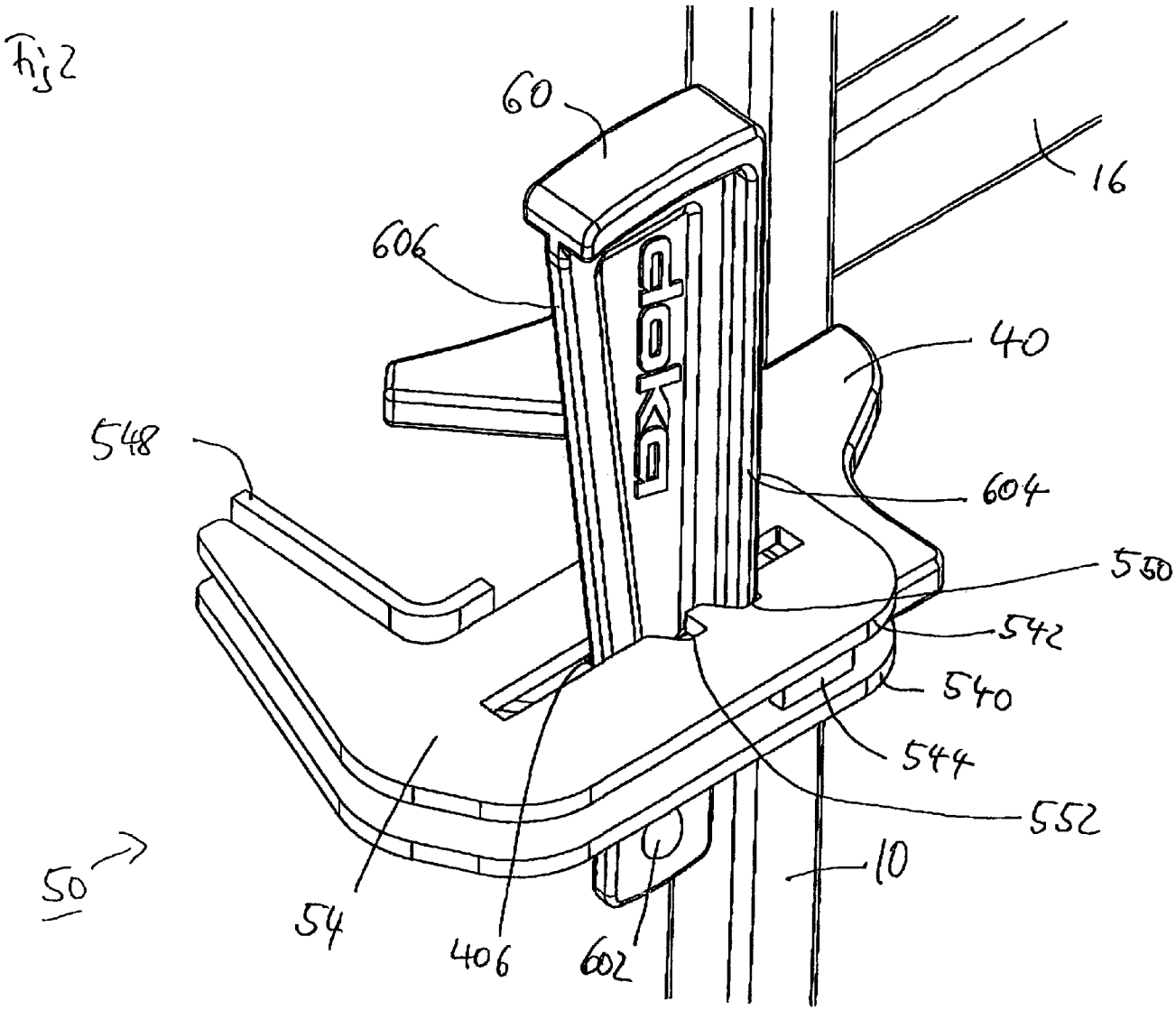
FIG. 2 shows a fastener for a bracing structure of FIG. 1.

As can clearly be seen from the drawing of FIG. 2, a key 60 is provided, which on one hand is in contact with its front side 606 on a front contact surface 406 of recess 40 and on the other with its rear side 604 engages in a rear seating position 550 in top key plate 542 and bottom key plate 540. In FIG. 2 key 60 is shown in its first seating position 550.

To accommodate larger prop diameters, a further recess 552 is provided in bottom and top key plate 540, 542 such that the opening for accepting a prop (width across flats) between seating element 40 and clamping element 54 can be further enlarged by removing key 60, for example by loosening of locking bolt 602, which prevents slipping out, and subsequent repositioning of key 60 in other seating position 552.

In essence, fastener 52 is constructed analogously.

Referring again to FIG. 1, bracing fasteners 70, 72, 74, 76 are provided which are designed as locking pawl bolts and are disposed in each case on the side of vertical profiles 10, 12 facing away from seating elements 20, 22, 24, 26 on the inside of the frame.

Bracing fasteners 70, 72, 74, 76 serve to locate cross braces between two adjacent rows of props in order to give the entire support structure the necessary static safety.

The bracing structure may also be used with the following procedure:

- Provision of bracing structure 1, for example according to the description above or according to one of the subsequent claims;
- Attachment of (front) seating elements 24, 26, 42 to a first prop, not shown here, especially a support structure;
- Clamping of the bracing structure by means of fastener 52 by moving clamping element 56 towards the recess of seating element 42;
- Attachment of a prop (not shown) of the same prop row to (rear) seating elements 20, 22, 40; and
- Clamping of the bracing structure by means of fastener 50 by moving clamping element 54 towards the recess of seating element 40 and thereby attachment of the bracing structure to the second prop.

In addition, the following steps may be carried out alone or in combination:

- Tightening of clamping elements 54, 56 of fasteners 50, 52 by driving in keys 60, 62;
- Moving of clamping elements 54, 56 towards the recess of seating elements 40, 42;

Adjustment of the width across the flats by introducing key 60 in either a first seating position 550 or a second seating position 552 of clamping element 54;

Fixing of cross braces to bracing fasteners 70, 72, 74, 76 for bracing of bracing structure 1 perpendicular to the plane of the frame.

What is claimed is:

1. Bracing structure for bracing a support structure having props for ceiling formworks, wherein the bracing structure comprises:

two vertical sections located at a distance from one another which are joined to one another by at least one horizontal section, on each vertical section is provided at least one seating element, which in each case has at least one seating recess for placement of a prop, whereby an opening direction of the at least one seating recess on the one vertical section and an opening direction of the at least one seating recess on the other vertical section point away from each other and the opening directions lie parallel to a plane defined by the vertical sections, wherein at least one fastener is provided on each vertical section for attaching the bracing structure to the prop, wherein at least one of the fasteners comprises at least one of the seating elements, wherein the fastener has a clamping element which cooperates with the seating element for clamping a prop, whereby the clamping element is disposed so as to be linearly displaceable in opposition to the opening direction of the relevant seating recess, wherein the clamping element has a slot, recess portions each extending from the slot, and at least two different predetermined seating surfaces each provided on a respective one of the recess portions, and the seating element has a contact surface, and wherein the fastener includes a locking element that is selectively operable to be engaged against either a first or second one of the seating surfaces and against the contact surface for clamping props of different dimensions between the seating and clamping elements depending on which one of the first and second seating surfaces is selected for engagement with the locking element wherein the locking element has a front side and a rear side, the rear side having an elongated projection that selectively engages one of the two seating surfaces while the front side engages the contact surface.

2. Bracing structure according to claim 1, wherein the clamping element is guided so as to be linearly displaceable on a section of the seating element.

3. Bracing structure according to claim 1, wherein the clamping element may be brought into its clamping position by means of the locking element.

4. Bracing structure according to claim 3, wherein the locking element is a locking key.

5. Bracing structure according to claim 1, wherein the fastener is disposed on the one vertical section in a different position to the fastener on the other vertical section.

6. Bracing structure according to claim 1, wherein the opening directions of all seating recesses of the seating elements disposed on one vertical section point in the same direction in each case.

7. Bracing structure according to claim 1, wherein the at least one seating recess associated with each of the vertical sections comprises multiple seating recesses associated with each of the vertical sections and the multiple seating recesses associated with at least one of the vertical sections lie in a common seating plane in each case with the result that a prop can be brought evenly into contact in all of the multiple seating recesses lying in the common seating plane.

8. Bracing structure according to claim 1, wherein at least one of the seating elements has a V-shaped seating recess.

9. Bracing structure according to claim 1, wherein at least one bracing fastener is provided for fastening a cross brace disposed perpendicular to the plane of the frame.

10. Bracing structure according to claim 9, wherein at least one cross brace fastener is a locking pawl bolt for attachment of a cross brace stay.

* * * * *